US011530104B2

(12) United States Patent
Okazaki

(10) Patent No.: US 11,530,104 B2
(45) Date of Patent: Dec. 20, 2022

(54) SHEET FEEDING APPARATUS AND IMAGE FORMING APPARATUS

(71) Applicant: CANON KABUSHIKI KAISHA, Tokyo (JP)

(72) Inventor: Shunsuke Okazaki, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/095,891

(22) Filed: Nov. 12, 2020

(65) Prior Publication Data

US 2021/0155432 A1 May 27, 2021

(30) Foreign Application Priority Data

Nov. 22, 2019 (JP) ..... JP2019-211679

(51) Int. Cl.
*B65H 11/02* (2006.01)
*B65H 1/04* (2006.01)
*G03G 15/00* (2006.01)

(52) U.S. Cl.
CPC ..... *B65H 11/02* (2013.01); *B65H 1/04* (2013.01); *B65H 2402/45* (2013.01); *G03G 15/6502* (2013.01)

(58) Field of Classification Search
CPC .... B65H 1/04; B65H 11/02; B65H 2405/324; B65H 2405/11162; B65H 2405/1117; B65H 2405/1124; B65H 2405/1134; B65H 2405/115; B65H 2407/21; G03G 15/6514
See application file for complete search history.

(56) References Cited

U.S. PATENT DOCUMENTS 8,087,658 B2 * 1/2012 Ohtsuki ..... G03G 21/1695 271/9.09
8,857,808 B2 10/2014 Matsumoto
9,067,747 B2 * 6/2015 Kawashima ..... B65H 1/04
9,452,902 B2 9/2016 Koga et al.
9,840,382 B2 12/2017 Okazaki et al.
2005/0062217 A1 * 3/2005 Asada ..... B65H 3/0669 271/162

(Continued)

FOREIGN PATENT DOCUMENTS

JP 10245141 A * 9/1998
JP 2000-198551 A 7/2000

(Continued)

*Primary Examiner* — Luis A Gonzalez
(74) *Attorney, Agent, or Firm* — Venable LLP

(57) ABSTRACT

A sheet feeding apparatus includes an apparatus body, an opening/closing member supported on the apparatus body, a sheet support supported on the opening/closing member, and a rotary feeding member provided on the apparatus body to feed the sheet supported on the sheet support in a feeding direction. A first engagement member is provided in the apparatus body, and a second engagement member is provided on a downstream end portion of the sheet support in the feeding direction and engages with the first engagement member in a vertical direction that intersects an axial direction of the rotary feeding member when the opening/closing member is positioned at the open position. The rotary feeding member is lowered toward the sheet supported on the sheet support in a case where the opening/closing member is positioned at the open position.

16 Claims, 13 Drawing Sheets

(56) References Cited

U.S. PATENT DOCUMENTS

| | | | | |
|---|---|---|---|---|
| 2015/0344244 | A1 | 12/2015 | Koga et al. | |
| 2017/0283194 | A1* | 10/2017 | Nakagawa | G03G 15/6514 |
| 2018/0118479 | A1* | 5/2018 | Ishii | B65H 3/04 |
| 2021/0099591 | A1* | 4/2021 | Arakawa | B65H 3/565 |

FOREIGN PATENT DOCUMENTS

| | | | |
|---|---|---|---|
| JP | 2013-129481 | A | 7/2013 |
| JP | 2013-212932 | A | 10/2013 |
| JP | 2016-005986 | A | 1/2016 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus equipped with the same.

Description of the Related Art

Hitherto, a printer including a main body sheet feeding apparatus for feeding sheets from a sheet feeding cassette provided in a printer main body having an image forming unit and further including a manual sheet feeding apparatus for feeding sheets from a manual feed tray has been proposed (refer to Japanese Patent Application Laid-Open Publication No. 2016-005986). This printer includes a right-side cover that can be opened and closed with respect to the printer body and a manual feed tray provided on an upper side of the right-side cover, wherein a sheet placed on the manual feed tray is fed by a pickup roller.

In order to achieve a stable sheet feeding performed in the manual sheet feeding apparatus according to Japanese Patent Application Laid-Open Publication No. 2016-005986, a certain accuracy is required in the relative positional relationship between the pickup roller and the manual feed tray. For example, in order to feed the sheet from the manual feed tray by the pickup roller, a predetermined feed pressure acts on the manual feed tray from the pickup roller. If the manual feed tray is deformed by the feed pressure, relative positional accuracy of the pickup roller and the manual feed tray may be deteriorated and stable sheet feeding performance may not be achieved.

SUMMARY OF THE INVENTION

According to one aspect of the present invention, a sheet feeding apparatus includes an apparatus body, an opening/closing portion supported on the apparatus body and configured to open and close with respect to the apparatus body, a sheet supporting portion supported on the opening/closing portion and configured to support a sheet in a state where the opening/closing portion is positioned at an open position where the opening/closing portion is opened with respect to the apparatus body, a rotary feeding member provided on the apparatus body and configured to feed the sheet supported on the sheet supporting portion in a feeding direction, a first engagement portion provided on the apparatus body, and a second engagement portion provided on a downstream end portion of the sheet supporting portion in the feeding direction, the second engagement portion being configured to engage with the first engagement portion in an intersecting direction that intersects an axial direction of the rotary feeding member in a state where the opening/closing portion is positioned at the open position.

Further features of the present invention will become apparent from the following description of exemplary embodiments with reference to the attached drawings.

DESCRIPTION OF THE EMBODIMENTS

First Embodiment

Overall Configuration

A first embodiment of the present invention will be described. A printer 1 serving as an image forming apparatus is a laser beam printer adopting an electrophotographic system for forming a monochrome toner image. In the following description, a sheet S may be paper, an OHT sheet and so on, to which image is to be formed by the printer 1.

Figure 1:
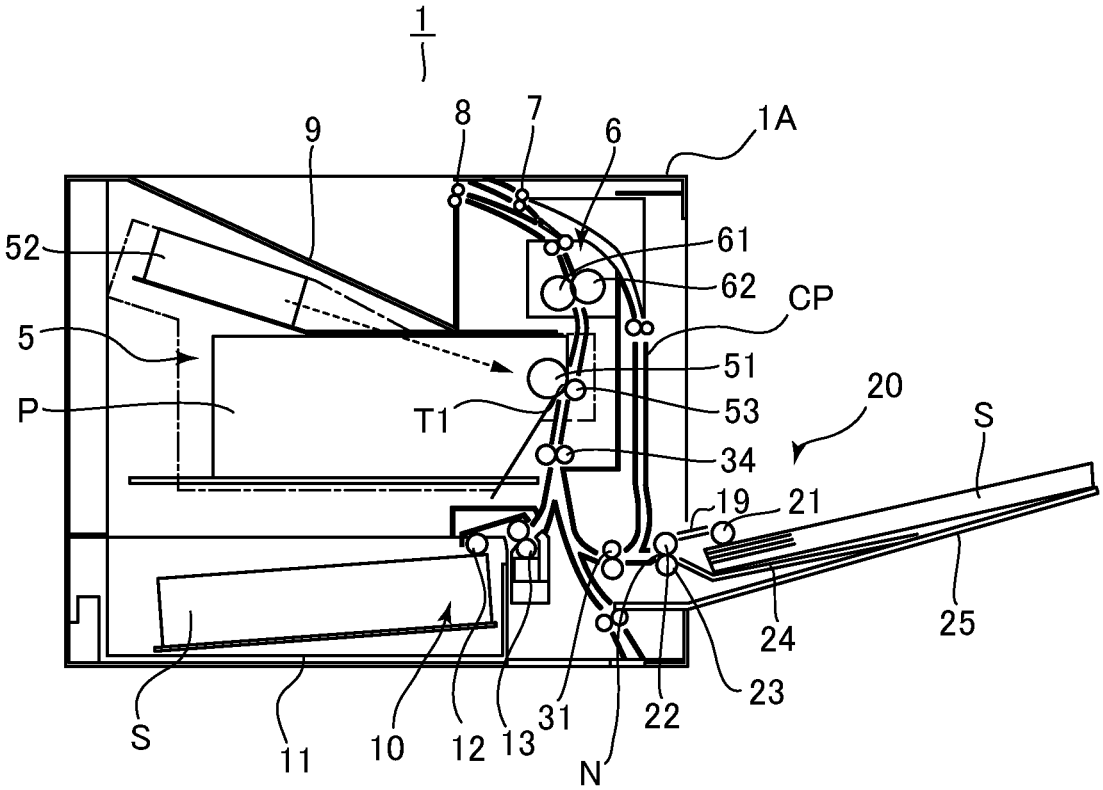
FIG. 1 is an entire schematic diagram illustrating a printer according to a first embodiment.

The printer 1 includes a main body sheet feed portion 10 for feeding sheets supported therein and a manual sheet feed portion 20, as illustrated in FIG. 1. The printer 1 also includes an image forming unit 5 for forming an image on a sheet fed by the main body sheet feed portion 10 or the manual sheet feed portion 20, a fixing unit 6 for fixing the image transferred to the sheet, and a sheet discharge roller pair 8 for discharging the sheet onto a sheet discharge tray 9.

When an image forming job is output to the printer 1, an image forming process by the image forming unit 5 is started based on image information entered from an external computer and the like connected to the printer 1. The image forming unit 5 is equipped with a laser scanner 52, a process cartridge P having a photosensitive drum 51, and a transfer roller 53. A charge roller, a developing roller and the like are provided in the circumference of the photosensitive drum 51. The photosensitive drum 51 and the transfer roller 53 form a transfer nip T1.

The laser scanner 52 irradiates laser beams on the photosensitive drum 51 based on the image information being entered. In this state, the photosensitive drum 51 is charged in advance by the charge roller, and an electrostatic latent image is formed on the photosensitive drum 51 by having laser beams irradiated thereon. Thereafter, the electrostatic latent image is developed by the developing roller, and a monochrome toner image is formed on the photosensitive drum 51.

In parallel with the image forming process described above, a sheet S is fed from either the main body sheet feed portion 10 or the manual sheet feed portion 20. The main body sheet feed portion 10 includes a cassette 11 that can be attached to and drawn out from an apparatus body 1A of the printer 1, a feed roller 12 and a separation roller pair 13. The sheet S stored in the cassette 11 is fed by the feed roller 12, and the sheet S fed by the feed roller 12 is separated from another sheet at a time by the separation roller pair 13.

Further, the manual sheet feed portion 20 serving as a sheet feeding apparatus includes a cover 25 supported in an openable/closable manner on the apparatus body 1A, a manual feed tray 24, a feed roller 21, a feeding arm 19, a conveyance roller 22 serving as a conveyance portion, and a separation roller 23 serving as a separation portion. The feed roller 21 serving as a rotary feeding member is retained rotatably on the feeding arm 19 and supported in a liftable/lowerable manner by the feeding arm 19. The sheet S supported on the manual feed tray 24 is manually fed by the feed roller 21, and the sheet S fed by the feed roller 21 is separated from another sheet at a time by the conveyance roller 22 and the separation roller 23. It is also possible to adopt an adhesion belt and the like that conveys the sheet while adhering the sheet on the belt, instead of the feed roller 21.

The separation roller 23 can adopt either a torque limiter system or a retard system, or a separating pad can be provided instead of the separation roller 23. The torque limiter system adopts a mechanism where a torque limiter is provided on a drive transmission path of the separation roller 23, and in a state where a load exceeding a set limit of the torque limiter acts on the separation roller 23, the separation roller 23 rotates idly. According to the retard system, in addition to the torque limiter system, a retard drive for driving the separation roller 23 in an opposite direction as a sheet conveyance direction of the conveyance roller 22 is entered to the rotation shaft of the separation roller 23.

A toner image on the photosensitive drum 51 is transferred at a transfer nip T1 to the sheet S fed from the main body sheet feed portion 10 or the manual sheet feed portion 20 and conveyed via a conveyance roller pair 34 by electrostatic load bias applied to the transfer roller 53. Residual toner remaining on the photosensitive drum 51 is collected by a cleaning blade not shown. Predetermined heat and pressure are applied from a fixing film 61 and a pressure roller 62 of the fixing unit 6 to the sheet S to which toner image has been transferred, and the toner is melted and fixed to the sheet S. A heating member such as a ceramic heater is provided inside the fixing film 61. The sheet S having passed the fixing unit 6 is discharged onto the sheet discharge tray 9 by the sheet discharge roller pair 8.

In order to form images on both sides of the sheet S, the sheet S having an image formed on a first side is subjected to switch-back by a reverse conveyance roller pair 7 and conveyed to a duplex conveyance path CP. The duplex conveyance path CP guides the sheet S to a conveyance roller pair 31. Then, the sheet S is conveyed again to the transfer nip T1 by the conveyance roller pairs 31 and 34, where an image is formed to a second side at the transfer nip T1 before the sheet S is discharged onto the sheet discharge tray 9.

Detailed Configuration of Manual Sheet Feed Portion

Figure 2:
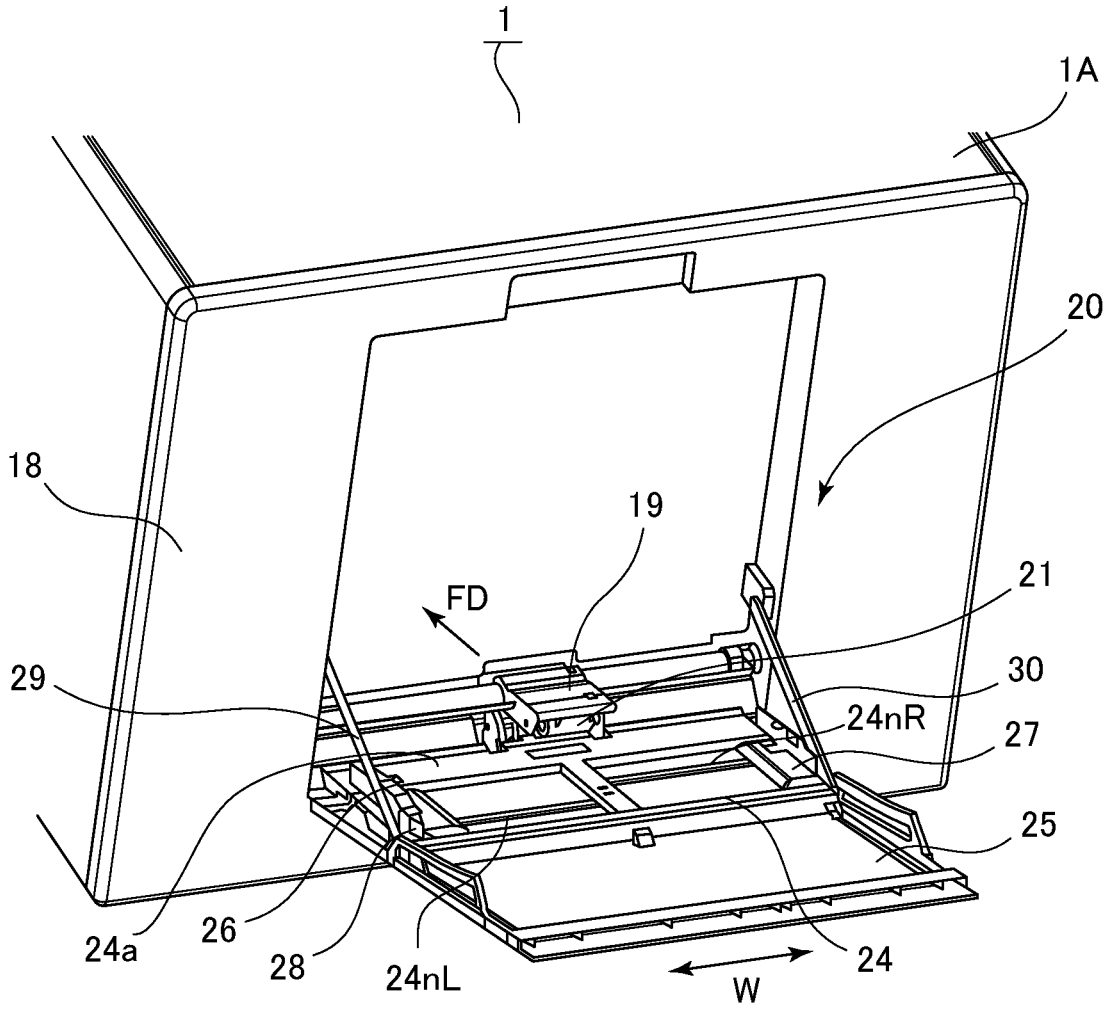
FIG. 2 is a perspective view illustrating a manual sheet feed portion.

Next, a detailed configuration of the manual sheet feed portion 20 will be described. As illustrated in FIG. 2, the cover 25 serving as an opening/closing portion is supported to open/close with respect to a right-side cover 18 provided on a right side of the apparatus body 1A, and a manual feed tray 24 is supported on the cover 25. The manual feed tray 24 serving as a sheet supporting portion supports a sheet in a state where the cover 25 is positioned at an open position with respect to the apparatus body 1A. The manual feed tray 24 includes a supporting surface 24*a* for supporting sheets.

When a job to feed a sheet from the manual sheet feed portion 20 is entered, the feed roller 21 is lowered by the feeding arm 19 and contacts an uppermost sheet supported on the manual feed tray 24. The feed roller 21 contacts the sheet supported on the manual feed tray 24 with a predetermined feed pressure by an urging mechanism not shown.

In the manual feed tray 24, a pair of side regulating plates 26 and 27 is supported movably in a width direction W orthogonal to a feeding direction FD. The width direction W is an axial direction of the feed roller 21. Guide grooves 24*n*L and 24*n*R are formed on the manual feed tray 24, and the side regulating plates 26 and 27 are guided in the width direction by the guide grooves 24*n*L and 24*n*R.

The side regulating plates 26 and 27 each include a rack portion not shown that extends in the width direction W at a side opposite from the supporting surface 24*a* of the manual feed tray 24. The rack portions are meshed via a pinion gear not shown. Thereby, the side regulating plates 26 and 27 are configured to be moved in an interlocked manner with each other in opposite directions in the width direction W.

Further, the manual sheet feed portion 20 includes a lock mechanism not shown for locking the side regulating plate 26, and the lock mechanism is released by operating an operation lever 28 provided on the side regulating plate 26.

Retaining Configuration of Manual Feed Tray

Next, a retaining configuration of the manual feed tray 24 will be described in detail. As illustrated in FIGS. 2 to 4, cover engagement holes 183 and 184 and link engagement holes 181 and 182 are provided on the right-side cover 18 of the apparatus body 1A. Projecting portions 253 and 254 engageable with the cover engagement holes 183 and 184 are provided on the cover 25, and pivot shafts 253*a* and 254*a* are respectively provided on the projecting portions 253 and 254. The cover 25 is supported pivotably around the pivot shafts 253*a* and 254*a* with respect to the apparatus body 1A in a state where the projecting portions 253 and 254 are engaged with the cover engagement holes 183 and 184.

Figure 3A:
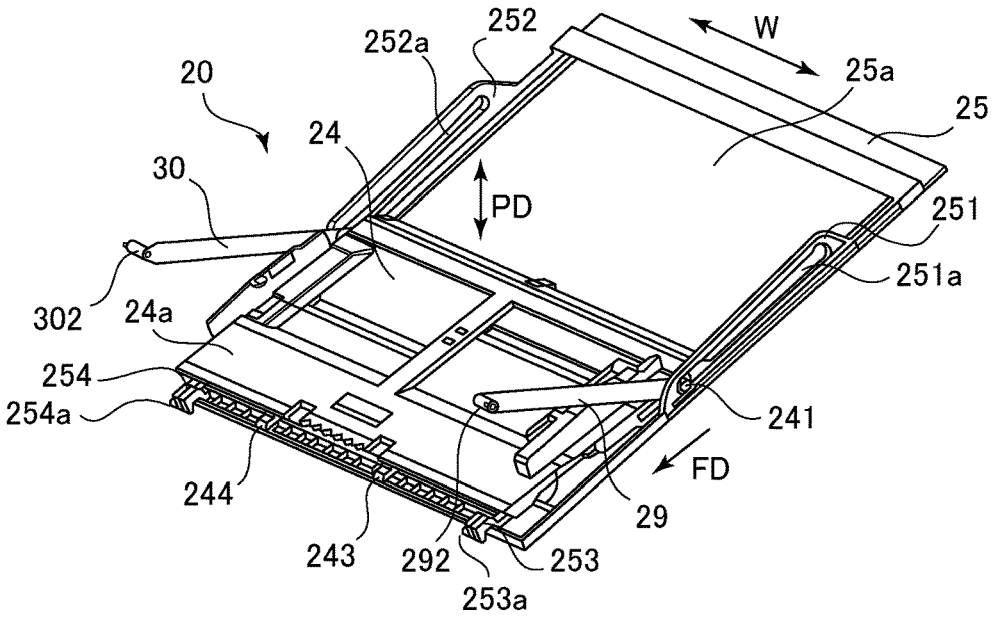
FIG. 3A is a perspective view illustrating a cover and a manual feed tray.
Figure 3B:
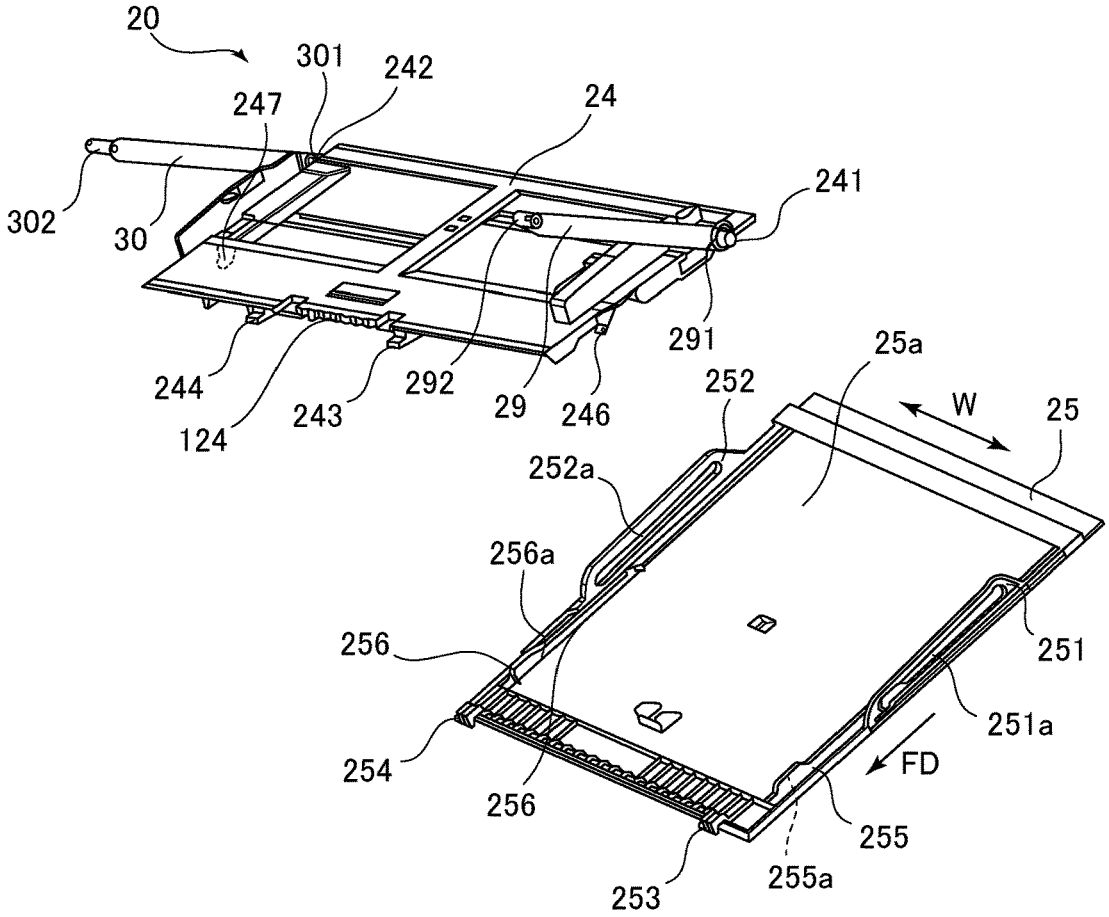
FIG. 3B is an exploded perspective view illustrating a cover and a manual feed tray.
Figure 4:
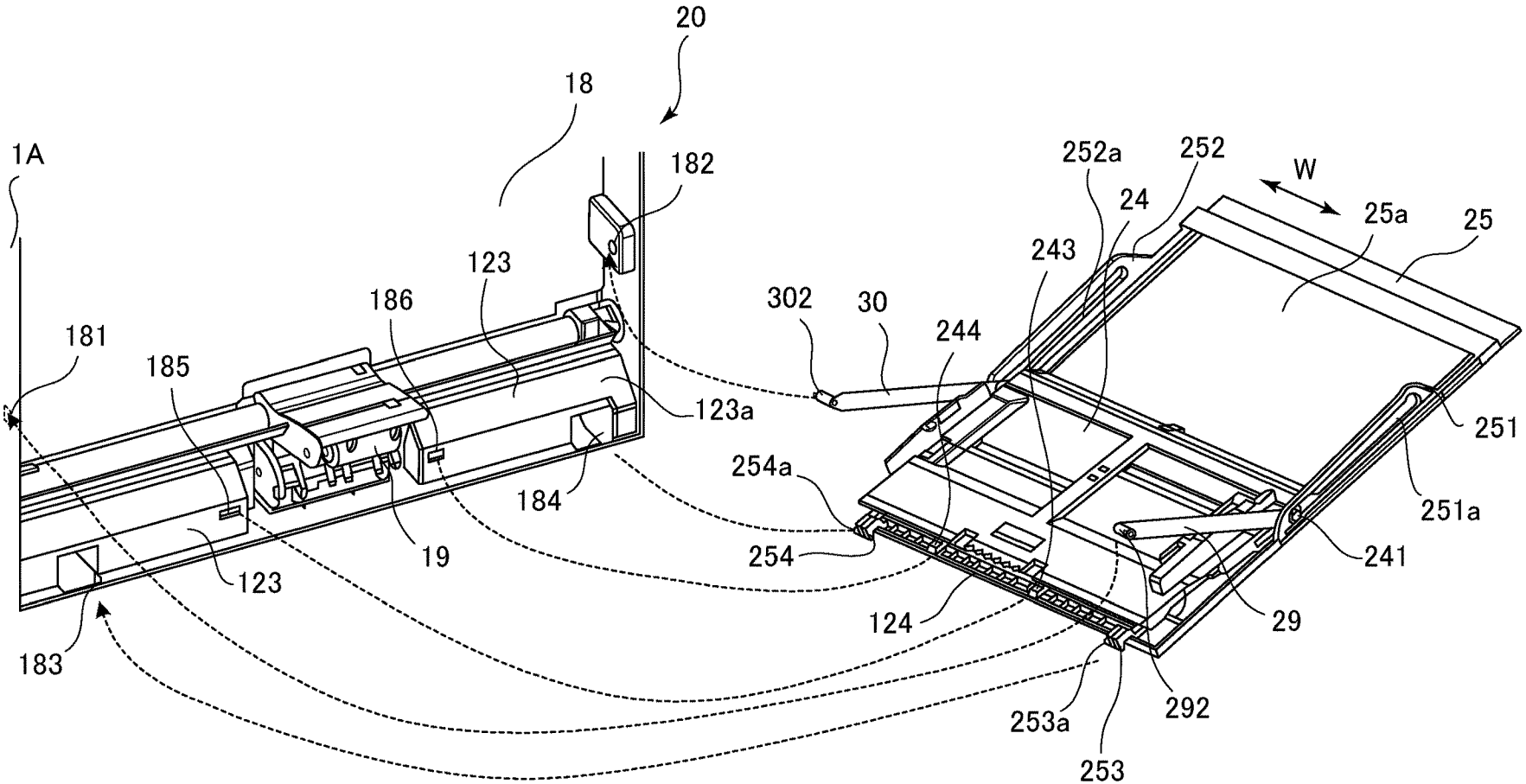
FIG. 4 is an exploded perspective view illustrating a manual sheet feed portion.

Further, as illustrated in FIGS. 3A and 3B, the cover 25 includes guide portions 251 and 255 provided on a first end side in the width direction W and guide portions 252 and 256 provided on a second end side in the width direction W. The guide portion 251 is arranged upstream of the guide portion 255 in the feeding direction FD, and the guide portion 252 is arranged upstream of the guide portion 256 in the feeding direction FD.

Guide hole portions 251*a* and 252*a* extending in the feeding direction FD are respectively provided on the guide portions 251 and 252, and lift preventing grooves 255*a* and 256*a* extending in the feeding direction FD are respectively provided on the guide portions 255 and 256.

The manual sheet feed portion 20 includes tray links 29 and 30, and the tray links 29 and 30 are arranged to oppose to one another with the manual feed tray 24 interposed in the width direction W. The tray link 29 includes a link supporting shaft 292 provided on a first end and a link hole 291 provided on a second end. Similarly, the tray link 30 includes a link supporting shaft 302 provided on a first end and a link hole 301 provided on a second end.

The tray links 29 and 30 are supported pivotably on the apparatus body 1A by having the link supporting shafts 292 and 302 respectively engage with the link engagement holes 181 and 182 on the right-side cover 18.

Meanwhile, the manual feed tray 24 includes supporting shafts 241 and 242 each extending in the width direction W, and the supporting shafts 241 and 242 are provided upstream of the manual feed tray 24 in the feeding direction FD. The supporting shaft 241 passes through the link hole 291 of the tray link 29 and engages with the guide hole portion 251*a* provided on the guide portion 251 of the manual feed tray 24. Further, the supporting shaft 242 passes through the link hole 301 of the tray link 30 and engages with the guide hole portion 252*a* provided on the guide portion 252 of the manual feed tray 24.

The supporting shafts 241 and 242 are movable along the guide hole portions 251*a* and 252*a*. Therefore, along with the opening and closing of the cover 25, the supporting shafts 241 and 242 move within the guide hole portions 251*a* and 252*a*, and the manual feed tray 24 moves in sliding motion along an upper face 25*a* of the cover 25 in an interlocked manner with the supporting shafts 241 and 242. In other words, the cover 25 supports the manual feed tray 24 movably along the direction of the supporting surface 24*a* of the manual feed tray 24. That is, the tray links 29 and 30 serving as interlocking portions move the manual feed tray 24 in the direction along the supporting surface 24*a* in an interlocked manner with the opening and closing of the cover 25.

Further, as illustrated in FIG. 3B, lift preventing pins 246 and 247 that protrude downward are provided on both end portions in the width direction W of the manual feed tray 24. The lift preventing pins 246 and 247 engage with the lift preventing grooves 255*a* and 256*a* serving as regulating portions respectively formed on the guide portions 255 and 256 of the cover 25. Thereby, the manual feed tray 24 is regulated from lifting up in the stacking direction of the sheet with respect to the cover 25 when the cover 25 pivots. That is, the position of the manual feed tray 24 is regulated in a normal direction PD of the supporting surface 24*a* of the manual feed tray 24.

Furthermore, as illustrated in FIGS. 3B and 4, engaging claws 243 and 244 serving as a second engagement portion and claw portion are provided on a downstream end portion 124 in the feeding direction FD of the manual feed tray 24. A guide portion 123 for rotatably retaining the separation roller 23 (refer to FIG. 1) is provided on the apparatus body 1A, and hole portions 185 and 186 serving as a first engagement portion capable of engaging with the engaging claws 243 and 244 are formed on the guide portion 123. Further, the guide portion 123 includes a guide surface 123*a* that guides the sheet toward a separation nip N (refer to FIG. 1) formed by the conveyance roller 22 and the separation roller 23. The manual feed tray 24 is directly positioned on the apparatus body 1A by engaging the engaging claws 243 and 244 respectively with the hole portions 185 and 186.

Opening/Closing Operation of Cover

Figure 5A:
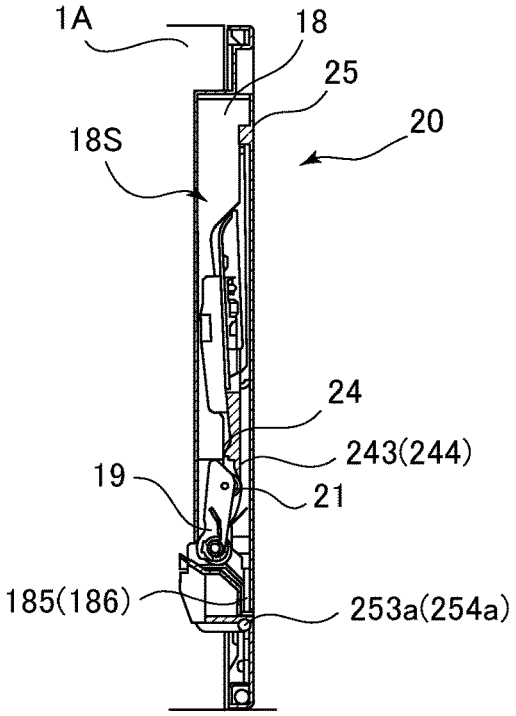
FIG. 5A is a cross-sectional view illustrating a manual sheet feed portion in a state where the cover is positioned at a closed position.
Figure 5B:
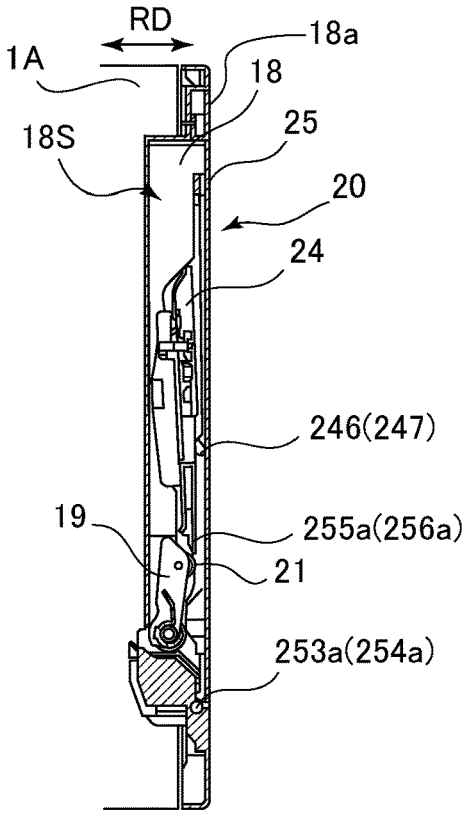
FIG. 5B is another cross-sectional view illustrating the manual sheet feed portion in a state where the cover is positioned at the closed position.

Next, the operations of respective members in a state where the cover 25 is opened and closed will be described. As illustrated in FIGS. 5A and 5B, in a state where the cover 25 is positioned at a closed position on the right-side cover 18 of the apparatus body 1A, the feeding arm 19 and the manual feed tray 24 are accommodated in an accommodating space 18S of the right-side cover 18.

In a state where the cover 25 is positioned at the closed position, the manual feed tray 24 is positioned at an upper position on an upper side of the accommodating space by the action of the tray links 29 and 30. Therefore, the engaging claws 243 and 244 of the manual feed tray 24 are separated from the hole portions 185 and 186. In other words, in a state where the cover 25 is positioned at the closed position, the engaging claws 243 and 244 are not engaged with the hole portions 185 and 186. Further, since the feeding arm 19 and the feed roller 21 are positioned at a lower side of the accommodating space 18S and the manual feed tray 24 is positioned at the upper side of the accommodating space 18S, the feeding arm 19, the feed roller 21 and the manual feed tray 24 nay be arranged in a compact manner in a right-left direction RD. The right-left direction RD is a direction orthogonal to a surface direction of an exterior surface 18*a* of the right-side cover 18.

Figure 6A:
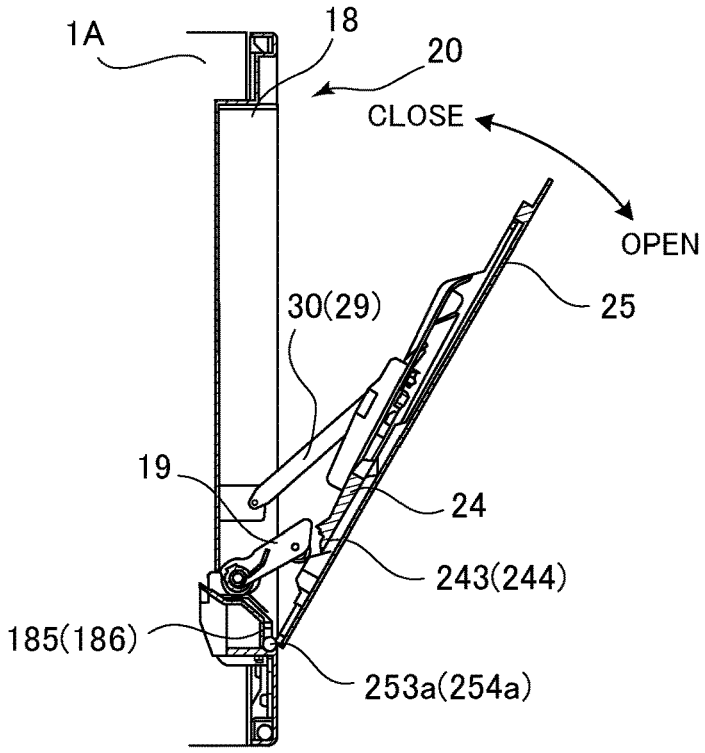
FIG. 6A is a cross-sectional view illustrating the manual sheet feed portion in a state where the cover is positioned at an intermediate position.
Figure 6B:
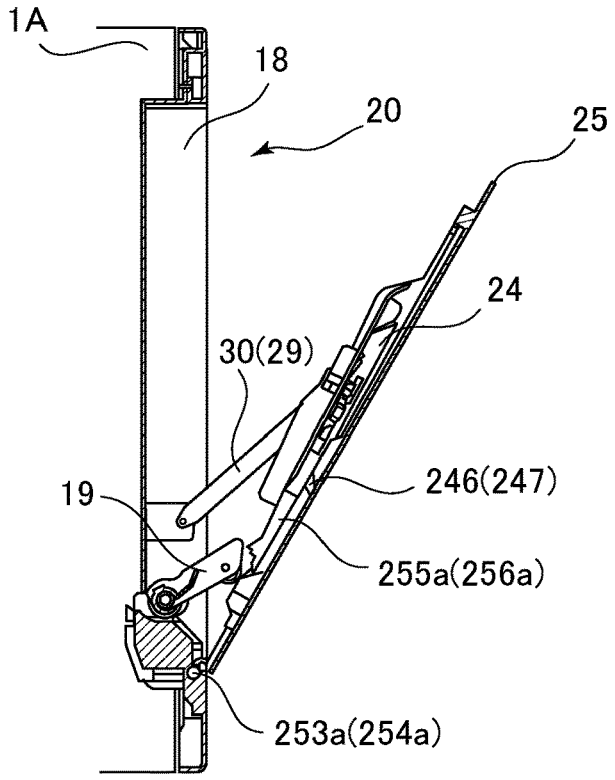
FIG. 6B is another cross-sectional view illustrating the manual sheet feed portion in a state where the cover is positioned at the intermediate position.

As illustrated in FIGS. 6A and 6B, in a state where the cover 25 is positioned at an intermediate position opened for a predetermined amount from the closed position, the manual feed tray 24 is positioned at a position between the upper position and the feed position by the action of the tray links 29 and 30. The feed position is the position of the manual feed tray 24 in which the sheet supported on the manual feed tray 24 can be fed, as illustrated in FIG. 2.

In this state, the engaging claws 243 and 244 of the manual feed tray 24 are separated from the hole portions 185 and 186, similar to the case of FIGS. 5A and 5B. As described, in a state where the cover 25 is positioned at the closed position or the intermediate position before reaching the open position as illustrated in FIG. 2, the engaging claws 243 and 244 are not engaged with the hole portions 185 and 186.

Meanwhile, in a state where the cover 25 is positioned at the closed position or the intermediate position, lifting of the lift preventing pins 246 and 247 of the manual feed tray 24 is regulated by upper walls of the lift preventing grooves 255*a* and 256*a* of the cover 25. Further, the supporting shafts 241 and 242 of the manual feed tray 24 are engaged with the guide hole portions 251*a* and 252*a*. According to this configuration, the manual feed tray 24 is moved in sliding motion along the feeding direction FD without falling from the cover 25 in the stacking direction of the sheet during the process of opening and closing the cover 25.

Figure 7A:
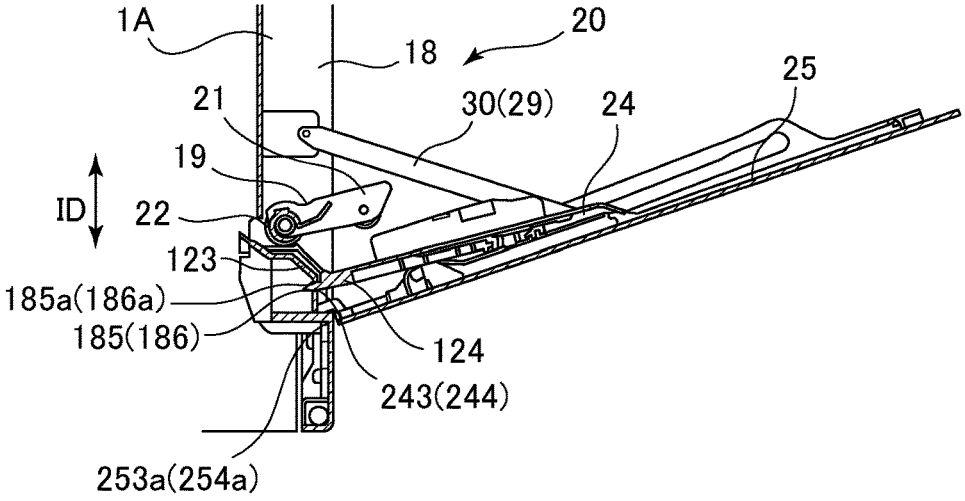
FIG. 7A is a cross-sectional view illustrating the manual sheet feed portion in a state where the cover is positioned at the open position.
Figure 7B:
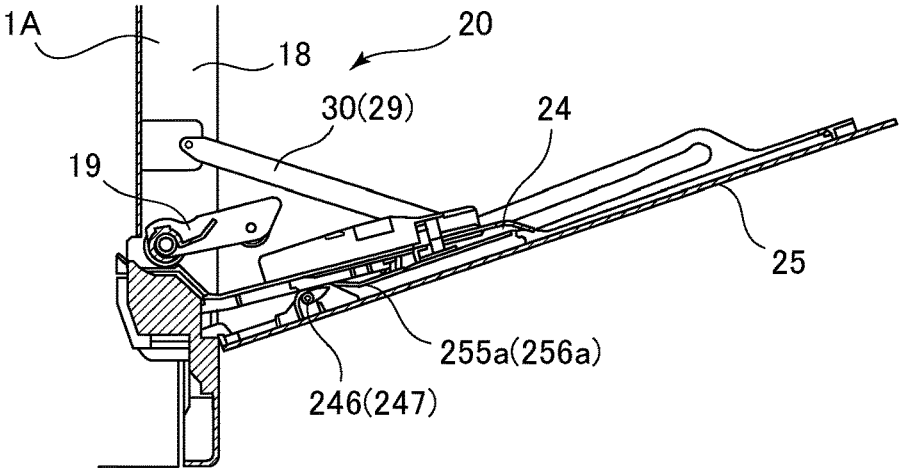
FIG. 7B is another cross-sectional view illustrating the manual sheet feed portion in a state where the cover is positioned at the open position.
Figure 7C:
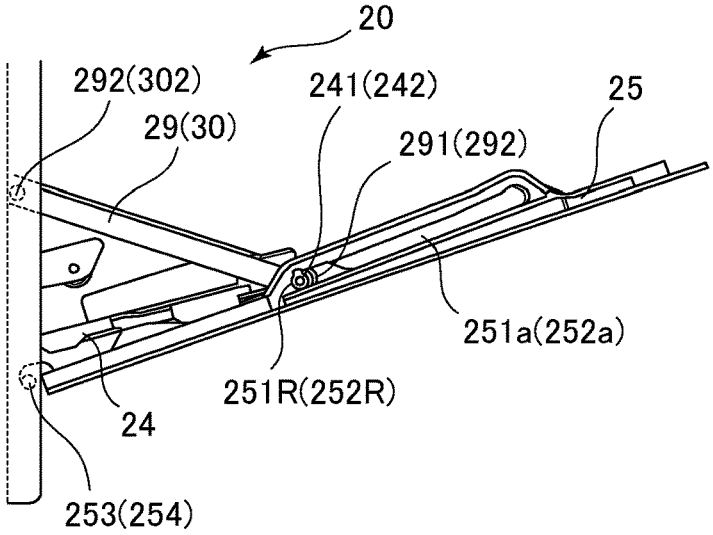
FIG. 7C is a side view illustrating the manual sheet feed portion in a state where the cover is positioned at the open position.

As illustrated in FIGS. 7A to 7C, in a state where the cover 25 is positioned at the open position, the manual feed tray 24 is positioned at the feed position by the action of the tray links 29 and 30. In this state, the supporting shafts 241 and 242 of the manual feed tray 24 are abutted against downstream ends 251R and 252R of the guide hole portions 251*a* and 252*a* in the feeding direction FD. The downstream ends 251R and 252R are arc-shaped having a substantially similar radius as the supporting shafts 241 and 242.

The weight of the manual feed tray 24 and the cover 25 acts in the direction to open the cover 25, and in a state where the supporting shafts 241 and 242 abut against the downstream ends 251R and 252R, the manual feed tray 24 is positioned at the feed position and the cover 25 is retained at the open position.

In this state, the engaging claws 243 and 244 provided on the manual feed tray 24 positioned at the feed position is engaged with the hole portions 185 and 186 in an intersecting direction ID orthogonal to the axial direction of the feed roller 21, corresponding to the width direction W of FIG. 2. In further detail, the engaging claws 243 and 244 position the manual feed tray 24 in the intersecting direction ID by being in contact with edge portions 185*a* and 186*a* of the hole portions 185 and 186. In the present embodiment, the term "engagement" not only refers to two elements being in direct contact with each other but also refers to a state where a position of one of two elements which are magnetically related is determined with respect to the other element. According further to the present embodiment, the intersecting direction ID is a direction that approximately corresponds to a stacking direction of the sheets supported on the manual feed tray 24, the direction in which the feed pressure received from the feed roller 21 acts on the sheet, and the vertical direction. For example, the intersecting direction ID is the vertical direction. The intersecting direction ID is not necessarily orthogonal, as long as it intersects the axial direction of the feed roller 21.

According to this arrangement, the manual feed tray 24 is positioned directly in the intersecting direction ID with respect to the apparatus body 1A, so that relative positional accuracy of the manual feed tray 24 with respect to the feed roller 21 can be improved. Thereby, stable feeding performance of the manual sheet feed portion 20 is achieved.

Meanwhile, the lift preventing pins 246 and 247 of the manual feed tray 24 is separated from the upper walls of the lift preventing grooves 255*a* and 256*a* of the cover 25 with a predetermined clearance therebetween. This is because the engaging claws 243 and 244 of the manual feed tray 24 are engaged with the hole portions 185 and 186. The manual feed tray 24 is slightly pivotable around the supporting shafts 241 and 242 within the range of width of the lift preventing grooves 255*a* and 256*a*, so that the engaging claws 243 and 244 can be engaged reliably to the hole portions 185 and 186 even if there is component tolerance.

When the cover 25 is opened from the apparatus body 1A, the tray links 29 and 30 move the manual feed tray 24 so that the engaging claws 243 and 244 are separated from the hole portions 185 and 186. Since the above-described clearance exists between the lift preventing pins 246 and 247 and the upper walls of the lift preventing grooves 255*a* and 256*a*, the manual feed tray 24 can be moved smoothly.

According to the above configuration, in a state where the cover 25 is positioned at the open position, the manual feed tray 24 is positioned at the feed position, that is, the position illustrated in FIG. 2 and FIGS. 7A to 7C. In this state, the position of the manual feed tray 24 in the feeding direction FD is determined by the supporting shafts 241 and 242 abutting against the downstream ends 251R and 252R of the guide hole portions 251*a* and 252*a*. Further, since the weight of the manual feed tray 24 and the cover 25 acts in the direction to open the cover 25, that is, in the direction to press the supporting shafts 241 and 242 against the downstream ends 251R and 252R, the position of the manual feed tray 24 can be determined more reliably in the feeding direction FD.

Further, since the engaging claws 243 and 244 of the manual feed tray 24 are engaged in the intersecting direction ID with the hole portions 185 and 186 of the guide portion 123 provided on the apparatus body 1A, the position of the manual feed tray 24 with respect to the guide portion 123 is determined in the intersecting direction ID. The intersecting direction ID is the direction orthogonal to the axial direction of the feed roller 21 and also the direction that approximately corresponds to the direction in which the feed pressure acts and the stacking direction of the sheets.

Since the engaging claws 243 and 244 are provided on the downstream end portion 124 in the feeding direction FD of the manual feed tray 24, the apparatus body 1A and the downstream end portion 124 of the manual feed tray 24 are directly positioned in the intersecting direction ID. Therefore, for example, feed pressure of the feed roller 21 acts on the downstream end portion 124 of the manual feed tray 24, but the engagement of the engaging claws 243 and 244 and the hole portions 185 and 186 enables to suppress deformation, vibration and dimensional variation of the manual feed tray 24. Therefore, relative positional accuracy of the feed roller 21 and the manual feed tray 24 is improved, and stable sheet feeding performance can be achieved.

Since the feed pressure can be received by the engaging claws 243 and 244 and the hole portions 185 and 186, the manual feed tray 24 itself is not required to have high stiffness. Specifically, the engaging claws 243 and 244 are arranged closer to the feed roller 21 in the width direction than the pivot shafts 253*a* and 254*a* of the cover 25, and they are arranged in parallel in the width direction W with the feed roller 21 interposed therebetween. In other words, the engaging claw 243 serving as a first engaging part is arranged on one side with respect to the feed roller 21 in the width direction W, while the engaging claw 244 serving as a second engaging part is arranged on the other side with respect to the feed roller 21 in the width direction W. Thereby, the engaging claws 243 and 244 and the hole portions 185 and 186 can receive feed pressure more reliably. According to the configuration, thickness of the manual feed tray 24 can be reduced, which leads to downsizing, resource-saving and reduction of costs of the apparatus.

Further, since the engaging claws 243 and 244 of the manual feed tray 24 are engaged with the hole portions 185 and 186 of the guide portion 123 having the guide surface 123*a* on which the sheets are guided, displacement of the manual feed tray 24 and the guide portion 123 can be suppressed, and accurate sheet feeding can be realized.

Further, along with the opening and closing of the cover 25, the manual feed tray 24 is moved in sliding motion along the upper face 25*a* of the cover 25. Therefore, in a state where the cover 25 is positioned at the closed position, the feeding arm 19, the feed roller 21 and the manual feed tray 24 can be accommodated in a compact manner in the accommodating space 18S.

Second Embodiment

Next, a second embodiment of the present invention will be described. In the second embodiment, a peripheral configuration of the manual feed tray according to the first embodiment is varied. Specifically, in the second embodiment, the tray links 29 and 30 of the first embodiment are omitted. Therefore, configurations similar to the first embodiment are either not shown or denoted with the same reference numbers.

Retaining Configuration of Manual Feed Tray

Figure 8:
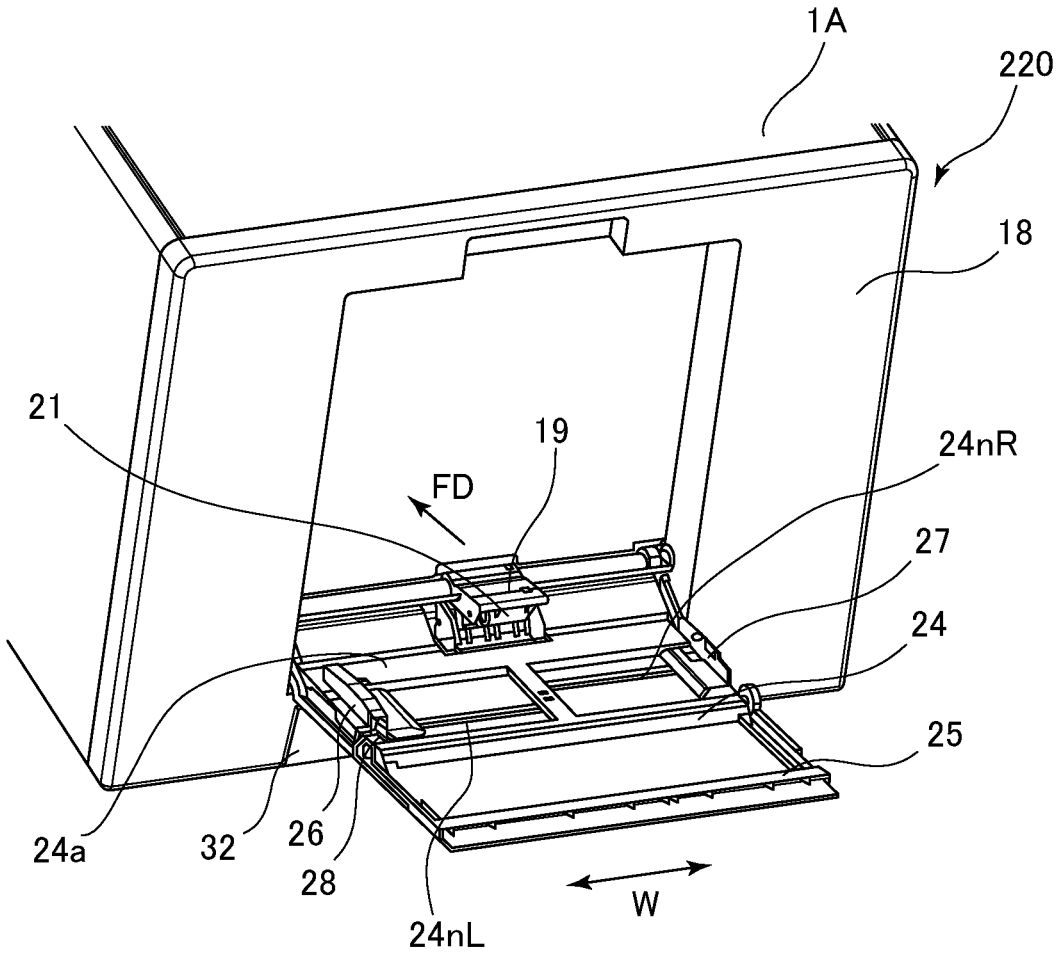
FIG. 8 is a perspective view illustrating a manual sheet feed portion according to a second embodiment.
Figure 9A:
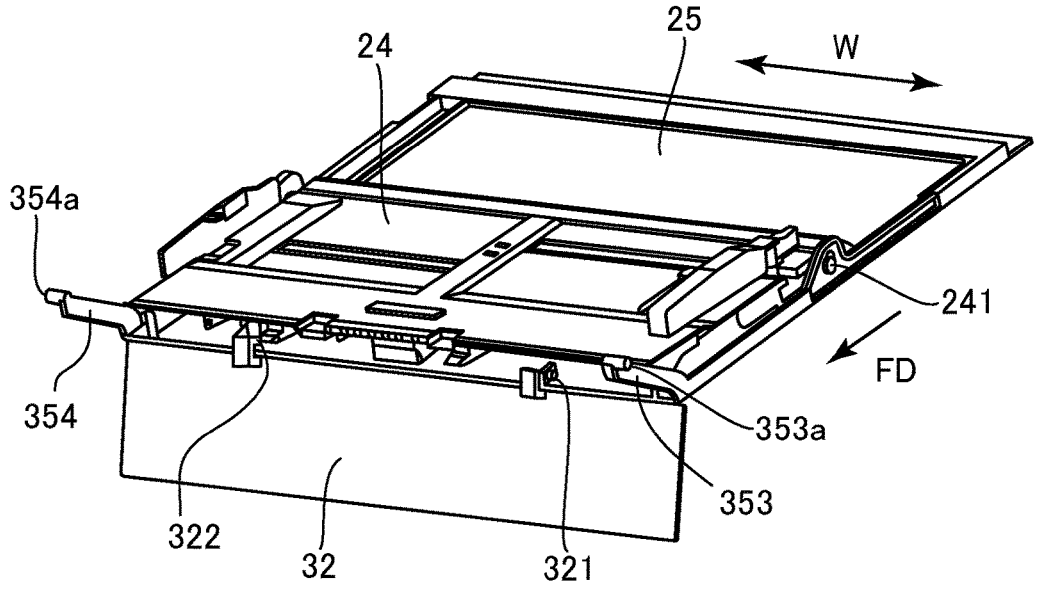
FIG. 9A is a perspective view illustrating a cover, a manual feed tray and a lower cover.

At first, a retaining configuration of the manual feed tray 24 provided on a manual sheet feed portion 220 serving as a sheet feeding apparatus according to a second embodiment will be described in detail. As illustrated in FIGS. 8 to 10, cover support holes 283 and 284 are provided on the right-side cover 18 of the apparatus body 1A. Extension portions 353 and 354 are extended from the downstream end portion in the feeding direction FD of the cover 25. Pivot shafts 353*a* and 354*a* engageable with the cover support holes 283 and 284 are provided on leading edge portions of the extension portions 353 and 354. The cover 25 is supported pivotably around the pivot shafts 353*a* and 354*a* on the apparatus body 1A.

Figure 9B:
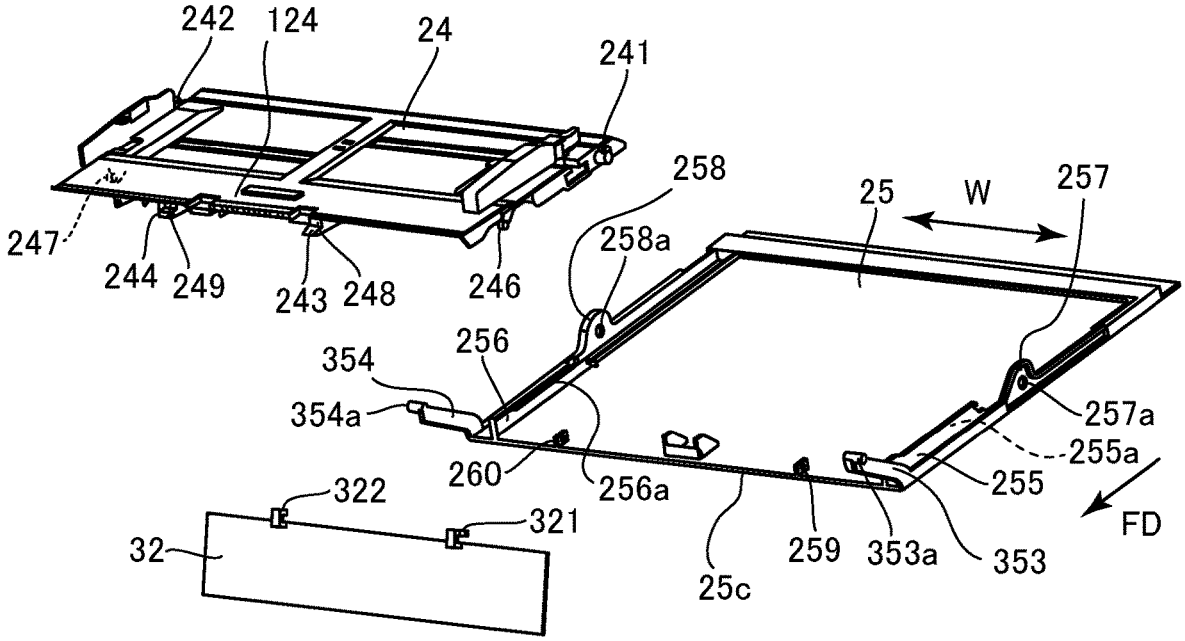
FIG. 9B is an exploded perspective view illustrating the cover, the manual feed tray and the lower cover.
Figure 10:
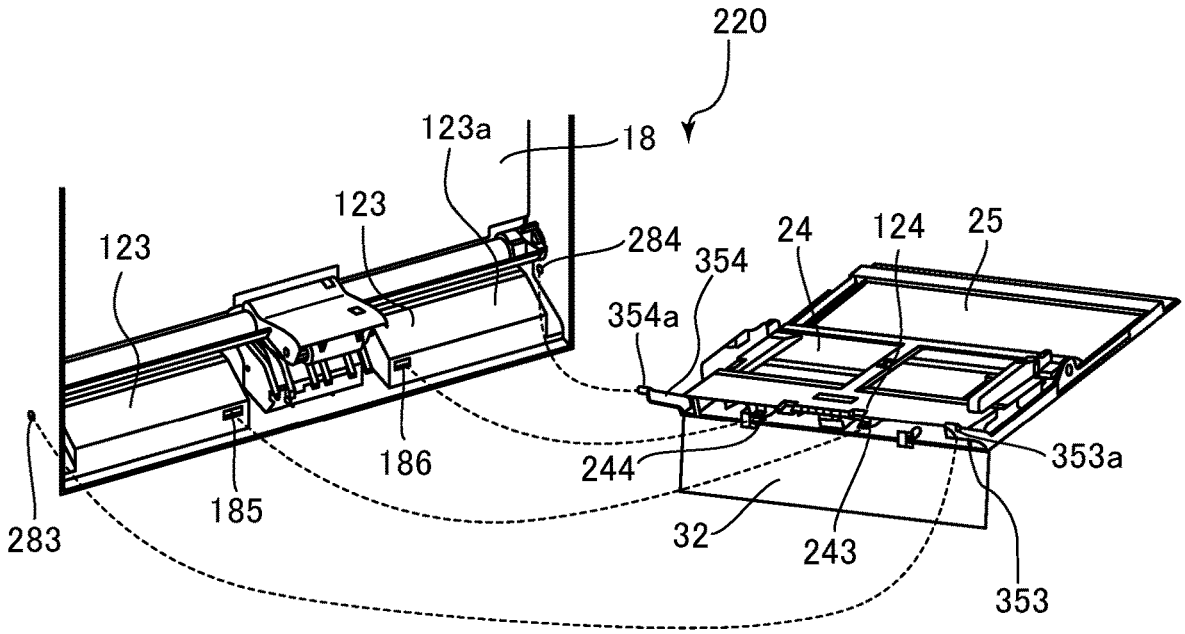
FIG. 10 is an exploded perspective view illustrating the manual sheet feed portion.

Further, the cover 25 includes a tray supporting portion 257 and a guide portion 255 on a first end side in the width direction W and a tray supporting portion 258 and a guide portion 256 on a second end side in the width direction W, as illustrated in FIG. 9B. The tray supporting portion 257 is arranged upstream of the guide portion 255 in the feeding direction FD, and the tray supporting portion 258 is arranged upstream of the guide portion 256 in the feeding direction FD. Tray support holes 257*a* and 258*a* to be engaged with the supporting shafts 241 and 242 of the manual feed tray 24 are formed on the tray supporting portions 257 and 258. Thereby, the manual feed tray 24 is slightly pivotable around the supporting shafts 241 and 242 within the range of width of the lift preventing grooves 255*a* and 256*a*.

As illustrated in FIGS. 9B and 10, engaging claws 243 and 244 and abutting surfaces 248 and 249 are provided on the downstream end portion 124 in the feeding direction FD of the manual feed tray 24. The engaging claw 243 and the abutting surface 248 are formed integrally on one side in the width direction W with respect to the feed roller 21. The engaging claw 244 and the abutting surface 249 are formed integrally on the other side in the width direction with respect to the feed roller 21. The engaging claws 243 and 244 are engageable with the hole portions 185 and 186 of the guide portion 123 provided on the apparatus body 1A, and the abutting surfaces 248 and 249 are capable of abutting against the guide portion 123.

Further, lower cover supporting portions 259 and 260 are formed on the downstream end portion in the feeding direction FD of the cover 25, and on the lower cover supporting portions 259 and 260 are supported pivot shafts 321 and 322 of a lower cover 32. The lower cover 32 is hung down in a state being supported by the lower cover supporting portions 259 and 260.

According to the present embodiment, when viewed in the axial direction of the pivot shafts 353*a* and 354*a*, a downstream end 25*c* in the feeding direction FD of an exterior face 25*b* (refer to FIG. 11) of the cover 25 is separated from the pivot shafts 353*a* and 354*a*. This is due to the presence of the extension portions 353 and 354.

Figure 11:
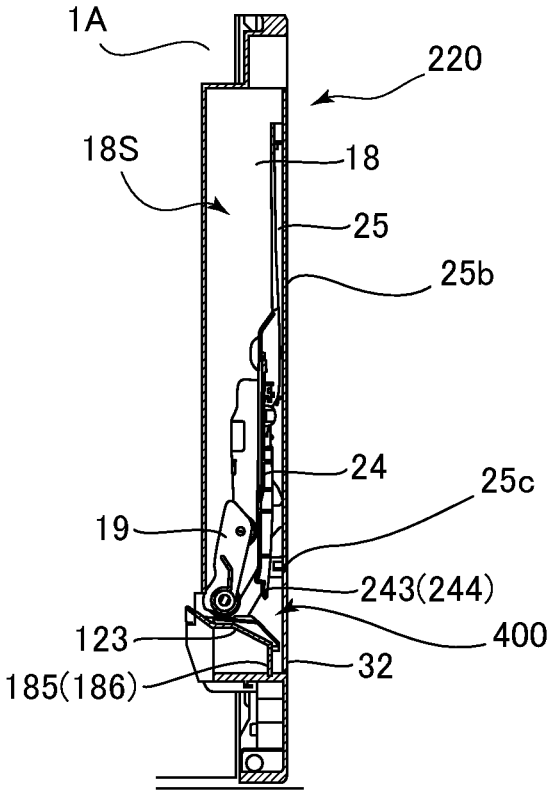
FIG. 11 is a cross-sectional view illustrating the manual sheet feed portion in a state where the cover is positioned at a closed position.

Therefore, in a state where the cover 25 is positioned at the closed position, an opening portion 400 is formed below the downstream end 25*c* of the cover 25, as illustrated in FIG. 11. The lower cover 32 serving as a cover member has a function to cover the opening portion 400.

Opening and Closing Operation of Cover

Next, operations of respective components during opening and closing of the cover 25 will be described. As illustrated in FIG. 11, in a state where the cover 25 is positioned at a closed position, the feeding arm 19 and the manual feed tray 24 are accommodated in the accommodating space 18S of the right-side cover 18. In this state, the engaging claws 243 and 244 of the manual feed tray 24 are separated from the hole portions 185 and 186. Further, the opening portion 400 is covered by the lower cover 32, according to which the appearance of the apparatus can be improved and foreign substances are suppressed from entering the apparatus through the opening portion 400.

Figure 12:
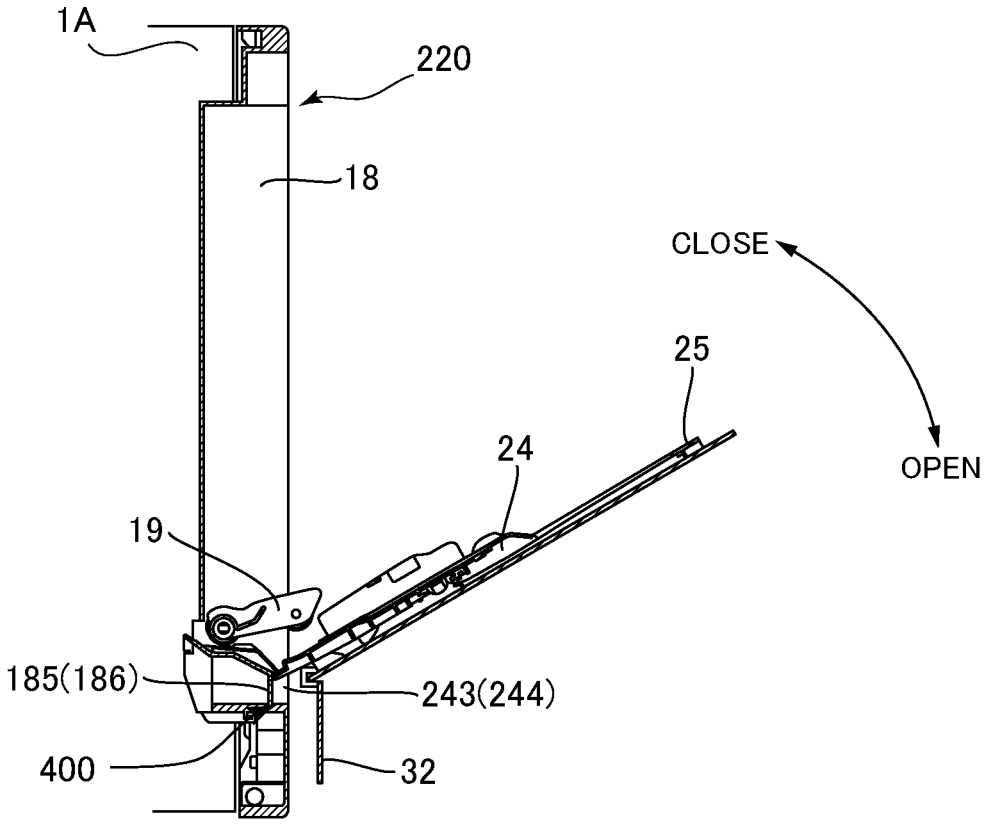
FIG. 12 is a cross-sectional view illustrating the manual sheet feed portion in a state where the cover is positioned at an intermediate position.

As illustrated in FIG. 12, in a state where the cover 25 is positioned at the intermediate position opened for a predetermined amount from the closed position, the engaging claws 243 and 244 of the manual feed tray 24 are separated from the hole portions 185 and 186, similar to FIG. 11. As described, in a state where the cover 25 is positioned at the closed position or the intermediate position before reaching the open position as illustrated in FIG. 2, the engaging claws 243 and 244 are not engaged with the hole portions 185 and 186.

Although not shown in the drawings, since it is similar to the first embodiment, in a state where the cover 25 is positioned at the closed position or the intermediate position, lifting of the lift preventing pins 246 and 247 of the manual feed tray 24 is suppressed by the upper walls of the lift preventing grooves 255*a* and 256*a* of the cover 25. According to this configuration, the manual feed tray 24 will not fall from the cover 25 in the stacking direction of the sheet during the process of opening and closing the cover 25.

Figure 13A:
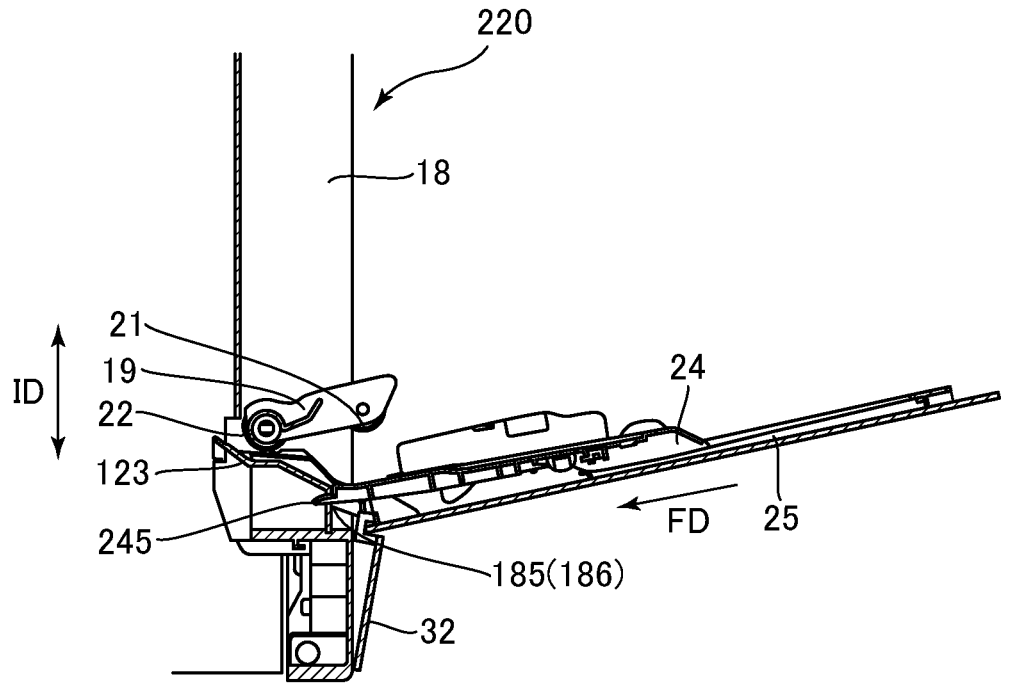
FIG. 13A is a cross-sectional view illustrating the manual sheet feed portion in a state where the cover is positioned at an open position.
Figure 13B:
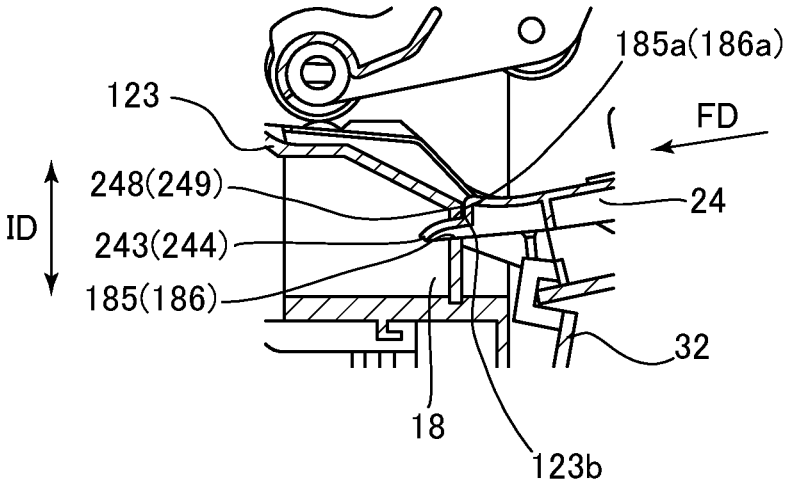
FIG. 13B is an enlarged cross-sectional view illustrating an engaging part of the manual feed tray and the guide portion.

As illustrated in FIGS. 13A and 13B, in a state where the cover 25 is positioned at the open position, the engaging claws 243 and 244 of the manual feed tray 24 are engaged with the hole portions 185 and 186 of the guide portion 123 in the intersecting direction ID orthogonal to the axial direction of the feed roller 21. More specifically, the engaging claws 243 and 244 position the manual feed tray 24 in the intersecting direction ID by coming into contact with the edge portions 185*a* and 186*a* of the hole portions 185 and 186. In the present embodiment, the intersecting direction ID is a direction that approximately corresponds to the stacking direction of the sheets supported on the manual feed tray 24, the direction in which the feed pressure from the feed roller 21 acts on the sheet, and the vertical direction. The intersecting direction ID is not necessarily orthogonal, as long as it intersects the axial direction of the feed roller 21.

The abutting surfaces 248 and 249 serving as a fourth engagement portion of the manual feed tray 24 abut against an abutted surface 123*b* serving as a third engagement portion of the guide portion 123 in a direction along the feeding direction FD. The weight of the manual feed tray 24 and the cover 25 acts in a direction to open the cover 25. Thereby, the engaging claws 243 and 244 engage reliably with the hole portions 185 and 186 in the intersecting direction ID, and the abutting surfaces 248 and 249 are reliably abutted against the abutted surface 123*b* of the guide portion 123 in a direction along the feeding direction FD. The abutted surface 123*b* is a surface that extends in the vertical direction. Thereby, the manual feed tray 24 is positioned directly and securely on the apparatus body 1A, and the relative positional accuracy of the manual feed tray 24 with respect to the feed roller 21 can be improved. Thereby, stable sheet feeding performance of the manual sheet feed portion 20 can be achieved.

Since the tray links 29 and 30 according to the first embodiment are omitted in the configuration of the present embodiment, in addition to realizing the effects of the first embodiment, the second embodiment will not receive any restrictions related to arranging the try links.

Other Embodiments

The first embodiment does not include abutting surfaces 248 and 249 that position the manual feed tray 24 in the direction along the feeding direction FD with respect to the guide portion 123, but it is possible to provide the abutting surfaces 248 and 249 in the first embodiment. Further, the first embodiment does not include the lower cover 32 that covers the opening portion 400 on the apparatus body 1A, but it is possible to provide the lower cover 32 in the first embodiment.

According to both embodiments, the present invention has been illustrated based on the manual sheet feed portion 20 of the printer 1, but the present invention is not limited thereto. For example, the present invention is applicable to a printer in which a sheet storage portion arranged at a lower portion of an image forming unit is exposed by opening an exterior cover, and sheets are supported on the sheet supporting portion and the exterior cover.

According to both embodiments, the hole portions 185 and 186 and the abutted surface 123*b* are provided on the guide portion 123, but the present invention is not limited thereto. The hole portions 185 and 186 and the abutted surface 123*b* can be provided on any of the components of the apparatus body 1A. Further, the engaging claws 243 and 244 can be provided on the apparatus body 1A and the hole portions 185 and 186 can be provided on the manual feed tray 24. Similarly, the abutting surfaces 248 and 249 can be provided on the apparatus body 1A and the abutted surface 123*b* can be provided on the manual feed tray 24. As described, the design of the configuration of connecting the manual feed tray 24 and the apparatus body 1A are not limited.

According to both embodiments, the present invention has been illustrated based on the printer 1 adopting an electrophotographic system, but the present invention is not limited thereto. For example, the present invention is applicable to an image forming apparatus adopting an inkjet system in which images are formed on a sheet by discharging ink through nozzles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-211679, filed Nov. 22, 2019, which is hereby incorporated by reference herein in its entirety.

What is claimed is:

1. A sheet feeding apparatus comprising:

an apparatus body;

an opening/closing member supported on the apparatus body and configured to open and close with respect to the apparatus body;

a sheet support supported on the opening/closing member and configured to support a sheet in a state where the opening/closing member is positioned at an open position where the opening/closing member is opened with respect to the apparatus body;

a rotary feeding member provided on the apparatus body and configured to feed the sheet supported on the sheet support in a feeding direction;

a first engagement member provided in the apparatus body; and a second engagement member provided on a downstream end portion of the sheet support in the feeding direction, the second engagement member being configured to engage with the first engagement member in a vertical direction that intersects an axial direction of the rotary feeding member in a state where the opening/closing member is positioned at the open position, wherein the rotary feeding member is lowered toward the sheet supported on the sheet support in a case where the opening/closing member is positioned at the open position, the first engagement member is a hole portion, and the second engagement member is configured to position the sheet support in a vertical direction by being in contact with an upper edge of the hole portion in a state where the opening/closing member is positioned at the open position.

2. The sheet feeding apparatus according to claim 1, wherein the second engagement member is configured not to be engaged with the first engagement member in a state where the opening/closing member is positioned at a closed position where the opening/closing member is closed with respect to the apparatus body.

3. The sheet feeding apparatus according to claim 1, wherein the second engagement member is a claw portion configured to engage with the hole portion, and the claw portion is configured to position the sheet support in the vertical direction by being in contact with an edge portion of the hole portion in a state where the opening/closing member is positioned at the open position.

4. The sheet feeding apparatus according to claim 1, wherein the apparatus body comprises a guide comprising a guide surface configured to guide the sheet fed by the rotary feeding member, and the first engagement member is provided on the guide.

5. The sheet feeding apparatus according to claim 4, wherein the apparatus body comprises a conveyor configured to convey the sheet fed by the rotary feeding member, and a separation mechanism configured to form a separation nip, which separates the sheet from another sheet, together with the conveyor, the guide is configured to guide the sheet toward the separation nip, and the guide is configured to retain the separation mechanism.

6. The sheet feeding apparatus according to claim 1, further comprising:

a third engagement member provided in the apparatus body; and a fourth engagement member provided on the downstream end portion of the sheet support, the fourth engagement member being configured to engage with the third engagement member in the feeding direction in a state where the opening/closing member is positioned at the open position.

7. The sheet feeding apparatus according to claim 6, wherein the fourth engagement member is a surface configured to abut against the third engagement member in the feeding direction in a state where the opening/closing member is positioned at the open position.

8. The sheet feeding apparatus according to claim 1, wherein the sheet support comprises a supporting surface configured to support the sheet, and the opening/closing member is configured to support the sheet support movably in a direction along the supporting surface.

9. The sheet feeding apparatus according to claim 8, further comprising an interlocking mechanism configured to move the sheet support in a direction along the supporting surface in an interlocked manner with opening and closing of the opening/closing member, wherein the interlocking mechanism is configured to move the sheet support such that the second engagement member is separated from the first engagement member in a case where the opening/closing member is opened with respect to the apparatus body.

10. The sheet feeding apparatus according to claim 1, wherein the sheet support is supported pivotably by the opening/closing member.

11. The sheet feeding apparatus according to claim 1, wherein the second engagement member comprises a first engaging part and a second engaging part configured to be arranged in parallel in the axial direction, the first engaging part is configured to be arranged on one side with respect to the rotary feeding member in the axial direction, and the second engaging part is configured to be arranged on the other side with respect to the rotary feeding member in the axial direction.

12. The sheet feeding apparatus according to claim 1, wherein the sheet support is a manual feed tray on which a sheet is manually fed.

13. An image forming apparatus comprising:

the sheet feeding apparatus according to claim 1; and an image forming unit configured to form an image on a sheet fed by the sheet feeding apparatus.

14. The sheet feeding apparatus according to claim 1, wherein the apparatus body includes a lifting member configured to liftably support the rotary feeding member in a vertical direction.

15. A sheet feeding apparatus comprising:

an apparatus body;

an opening/closing member supported on the apparatus body and configured to open and close with respect to the apparatus body;

a sheet support supported on the opening/closing member and configured to support a sheet in a state where the opening/closing member is positioned at an open position where the opening/closing member is opened with respect to the apparatus body;

a rotary feeding member provided on the apparatus body and configured to feed the sheet supported on the sheet support in a feeding direction;

a first engagement member provided in the apparatus body; and a second engagement member provided on a downstream end portion of the sheet support in the feeding direction, the second engagement member being configured to engage with the first engagement member in a vertical direction that intersects an axial direction of the rotary feeding member in a state where the opening/closing member is positioned at the open position, wherein the rotary feeding member is lowered toward the sheet supported on the sheet support in a case where the opening/closing member is positioned at the open position, the sheet support comprises a supporting surface configured to support the sheet, and the opening/closing member comprises a regulator configured to regulate a position of the sheet support in a normal direction of the supporting surface.

16. A sheet feeding apparatus comprising:

an apparatus body;

an opening/closing member supported on the apparatus body and configured to open and close with respect to the apparatus body;

a sheet support supported on the opening/closing member and configured to support a sheet in a state where the opening/closing member is positioned at an open position where the opening/closing member is opened with respect to the apparatus body;

a rotary feeding member provided on the apparatus body and configured to feed the sheet supported on the sheet support in a feeding direction;

a first engagement member provided in the apparatus body; and a second engagement member provided on a downstream end portion of the sheet support in the feeding direction, the second engagement member being configured to engage with the first engagement member in a vertical direction that intersects an axial direction of the rotary feeding member in a state where the opening/closing member is positioned at the open position, wherein the rotary feeding member is lowered toward the sheet supported on the sheet support in a case where the opening/closing member is positioned at the open position, the apparatus body comprises an opening below the opening/closing member in a state where the opening/closing member is positioned at a closed position with respect to the apparatus body, and the sheet feeding apparatus further comprises a cover supported by the opening/closing member and configured to cover the opening.

* * * * *